US006010029A

United States Patent [19]

Wang

[11] Patent Number: 6,010,029

[45] Date of Patent: Jan. 4, 2000

[54] CONTAINER LID ASSEMBLY

[76] Inventor: Jung-Liang Wang, No. 42-3, Hsin-Le Rd., An-Ping Industrial Dist, Tainan, Taiwan

[21] Appl. No.: 09/200,756

[22] Filed: Nov. 27, 1998

[51] Int. Cl.[7] ..... A47G 19/22

[52] U.S. Cl. ..... 220/714; 220/254; 220/715; 222/506; 222/557; D7/511

[58] Field of Search ..... 220/714, 715, 220/253, 254; 215/11.4, 11.5, 11.6, 387; 222/505, 506, 545, 557; D7/511

[56] References Cited

U.S. PATENT DOCUMENTS

| | | | |
|---|---|---|---|
| D. 370,156 | 5/1996 | Feltman, III et al. | D7/536 |
| D. 382,174 | 8/1997 | Grimm | D7/510 |
| 4,171,060 | 10/1979 | Howard et al. | 220/254 |
| 4,190,173 | 2/1980 | Mason et al. | 220/203 |
| 4,790,444 | 12/1988 | Terzi | 220/714 |
| 5,186,353 | 2/1993 | Ramsey | 220/711 |
| 5,294,014 | 3/1994 | Wyatt et al. | 220/253 |

*Primary Examiner*—Stephen K. Cronin
*Attorney, Agent, or Firm*—Varndell & Varndell, P.C.

[57] ABSTRACT

A lid assembly includes a lid body having a periphery containing a liquid discharge slot and an air vent arranged diametrically opposite to each other, and a center containing a passage located between the liquid discharge slot and the air vent, a rotary cap rotatably mounted on the top of the lid body and including a drive post extending downward from the bottom thereof, and extending through the passage, a control device mounted on the bottom of the lid body and secured to the drive post to rotate therewith. In such a manner, the control device can be rotated by the drive post to move between a first position where the liquid discharge slot and the air vent are closed by the control device, and a second position where the liquid discharge slot and the air vent are detached from and opened by the control device.

16 Claims, 5 Drawing Sheets

CONTAINER LID ASSEMBLY

CROSS-REFERENCES TO RELATED APPLICATIONS

Not Applicable.

BACKGROUND OF THE INVENTION

1. Field of the Invention

The present invention relates to a lid assembly for a container.

2. Description of the Related Art

A conventional lid assembly in accordance with the prior art shown in FIGS. 5 and 6 can be fit onto a container body (87) of a container such as a thermos cup which is used in an automobile. The lid assembly comprises a lid body (70) mounted to the container body (87) and including an inclined bottom plate (71) containing therein a liquid discharge slot (72), an air vent (73), and an opening (74), a gasket (86) mounted between the lid body (70) and the container body (87), an elongated control plate (83) mounted on the bottom of the bottom plate (71) for opening/closing the liquid discharge slot (72) and the air vent (73), and including a stub (84) slidably extending through the opening (74), a C-ring (85) clamping the upper portion of the stub (84), a spring (741) mounted on the stub (84) and pressing between the C-ring (85) and the bottom plate (71), a support rack (75) mounted on the bottom plate (71) and containing a guide slot (76) therein, and a slide (80) including a push button (81) slidably extending through the guide slot (76), and a wedge (82) detachably abutting the top of the stub (84).

In operation, the push button (81) can be pushed to slide in the guide slot (76) so as to move the control plate (83) downward by means of the wedge (82) pressing the stub (84) downward, thereby opening the liquid discharge slot (72) and the air vent (73) such that liquid contained in the container body (87) can flow outward via the liquid discharge slot (72). When the push button (81) is returned to its original position, the stub (84) is pressed upward by the returning force of the spring (741) so as to move the control plate (83) upward, thereby closing the liquid discharge slot (72) and the air vent (73).

In such a manner, however, biasing effect of the spring (741) will die during long-term utilization due to fatigue, thereby causing the lid assembly to become inoperable. In addition, the sealing effect between the control plate (83) and the liquid discharge slot (72), the air vent (73), and the opening (74) is not sufficient to seal the liquid inside the container body (87). The present invention has arisen to mitigate and/or obviate the disadvantage of the conventional lid assembly.

BRIEF SUMMARY OF THE INVENTION

In accordance with one aspect of the present invention, there is provided a lid assembly comprising a lid body having a periphery containing a liquid discharge slot and an air vent arranged radially opposite to each other, and a center containing a passage located between the liquid discharge slot and the air vent, a rotary cap rotatably mounted on the top of the lid body and including a drive post extending downward from the bottom thereof and extending through the passage, a control device mounted on the bottom of the lid body and secured to the drive post to rotate therewith, the control device being rotated by the drive post between a first position where the liquid discharge slot and the air vent are closed by the control device, and a second position where the liquid discharge slot and the air vent are detached from and opened by the control device.

Further benefits and advantages of the present invention will become apparent after a careful reading of the detailed description with appropriate reference to the accompanying drawings.

DETAILED DESCRIPTION OF THE INVENTION

Figure 1:
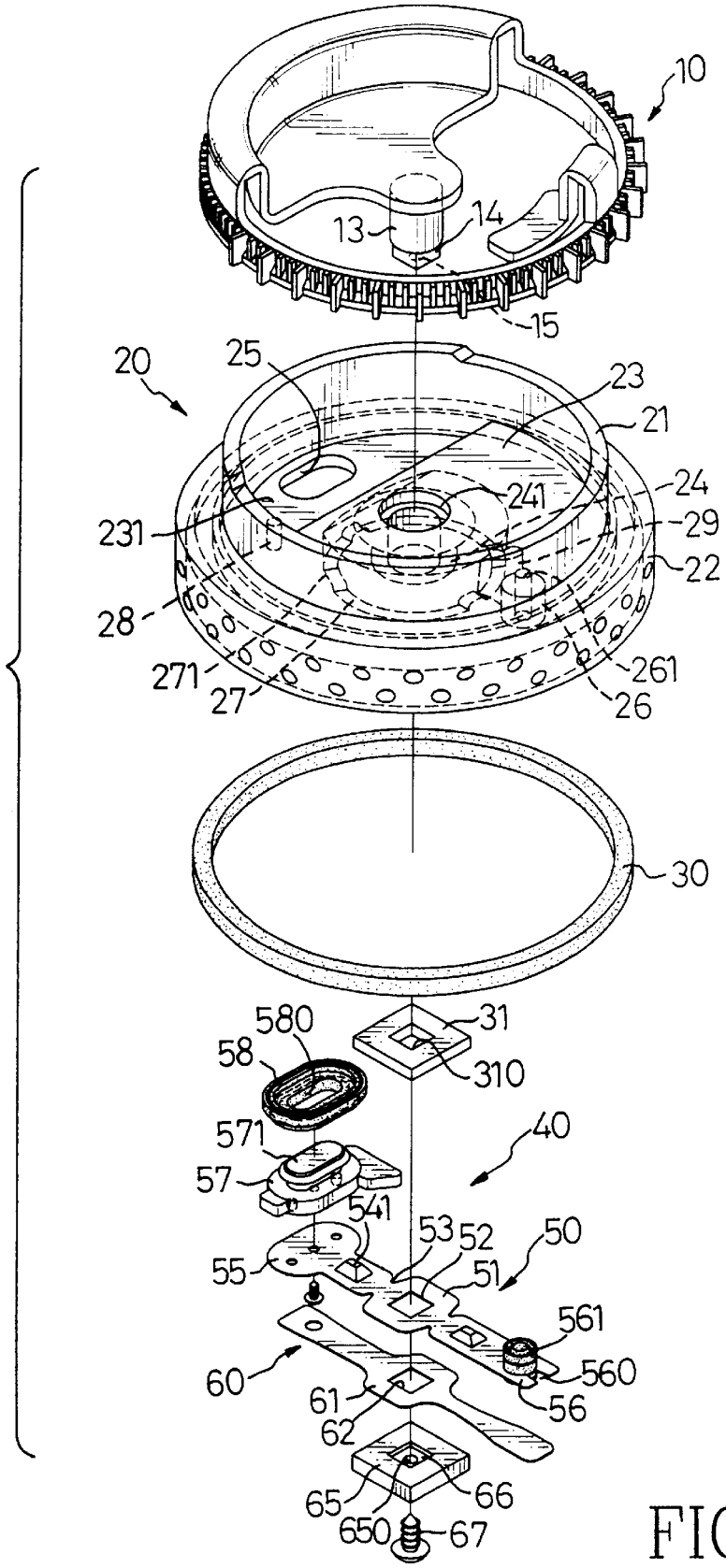
FIG. 1 is an exploded perspective view of a container lid assembly in accordance with the present invention.
Figure 2:
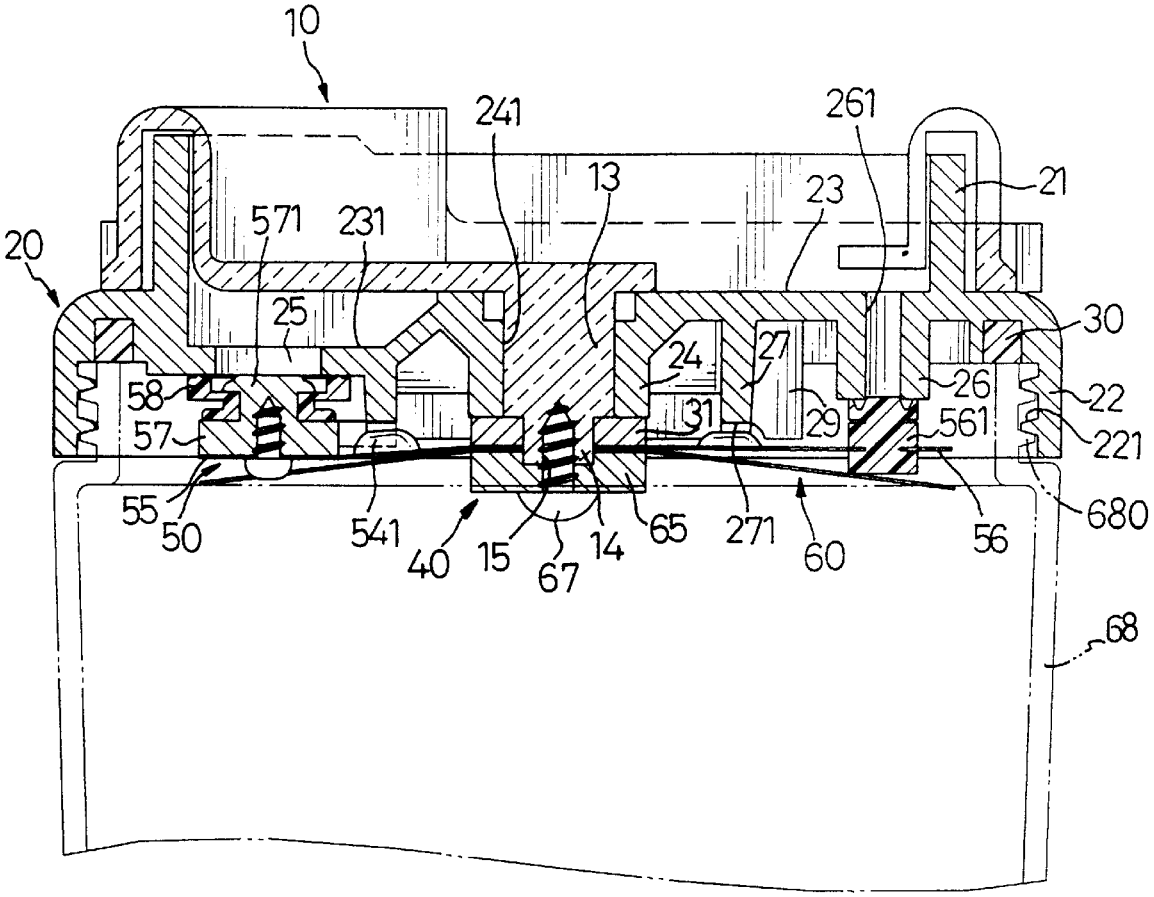
FIG. 2 is a front plan cross-sectional assembly view of the container lid assembly as shown in FIG. 1.
Figure 3:
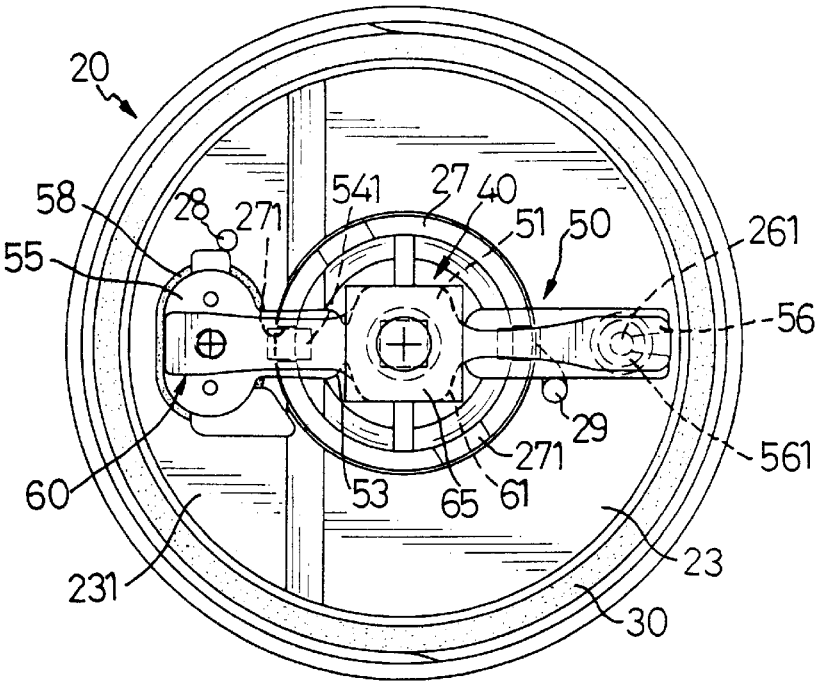
FIG. 3 is a bottom plan assembly view of the container lid assembly as shown in FIG. 1.
Figure 4:
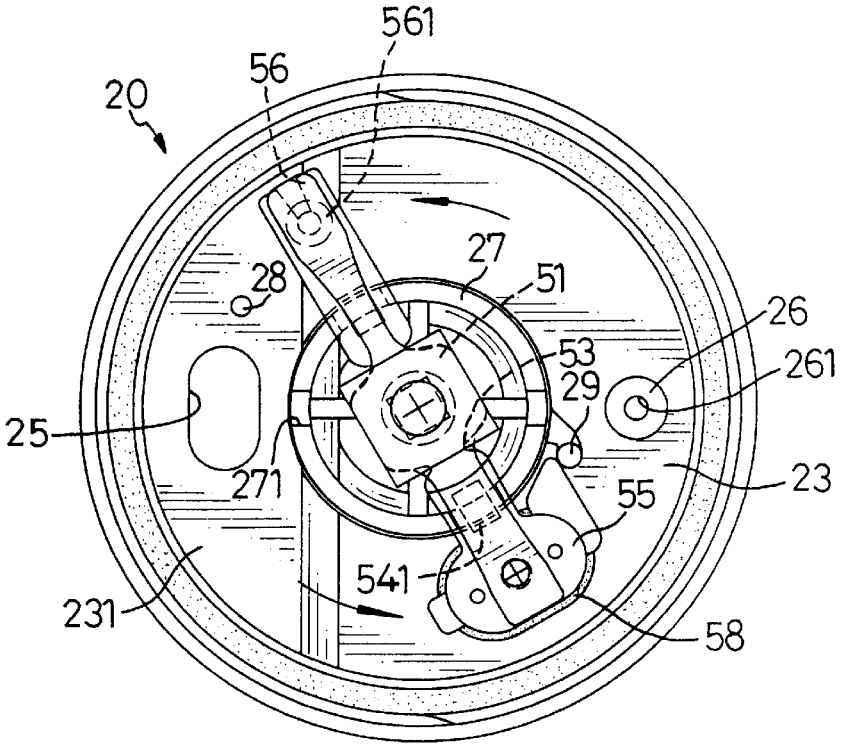
FIG. 4 is an operational view of the container lid assembly as shown in FIG. 3.
Figure 5:
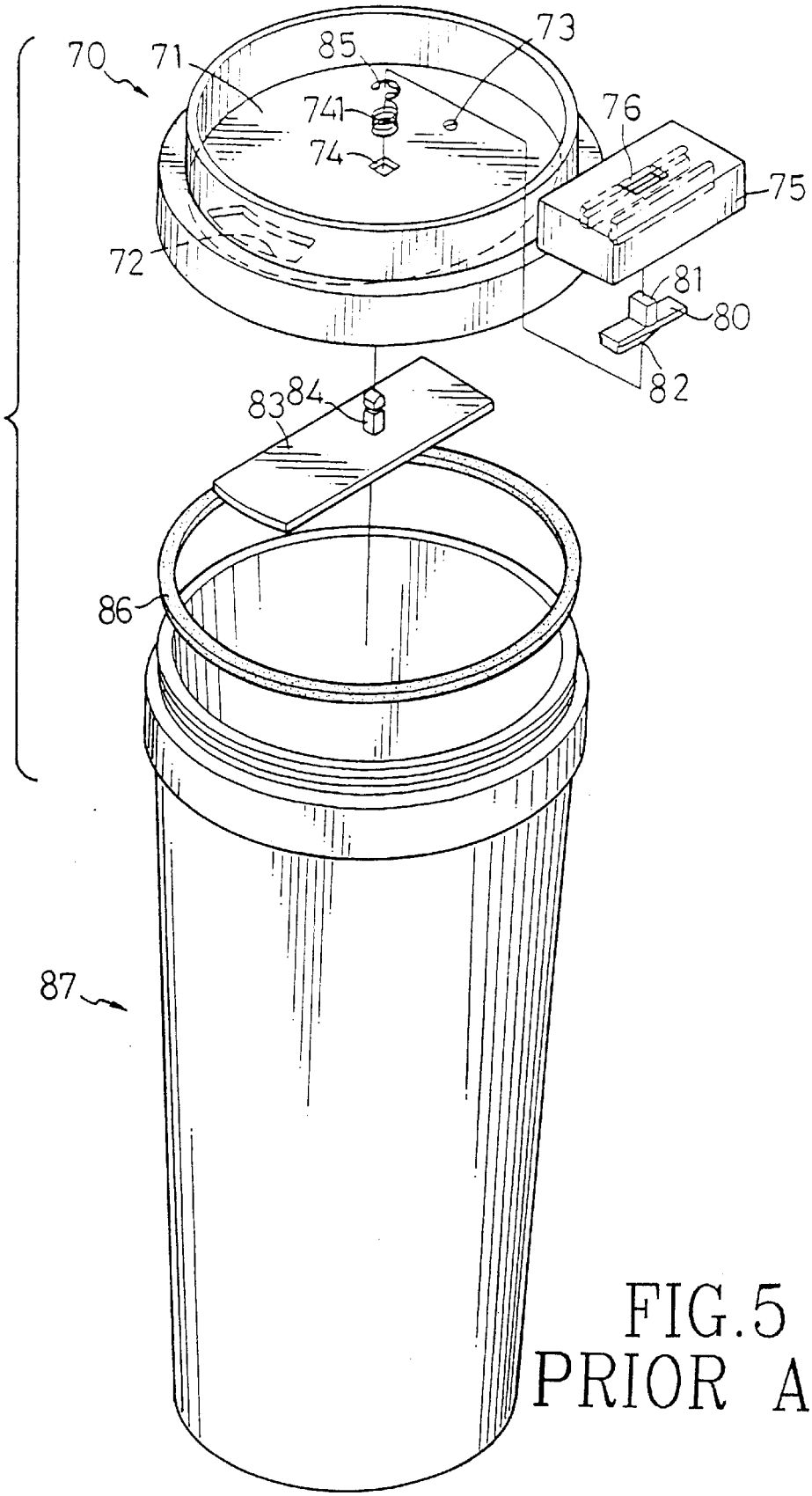
FIG.5 PRIOR ART
FIG. 5 is an exploded perspective view of a conventional container lid assembly in accordance with the prior art.
Figure 6:
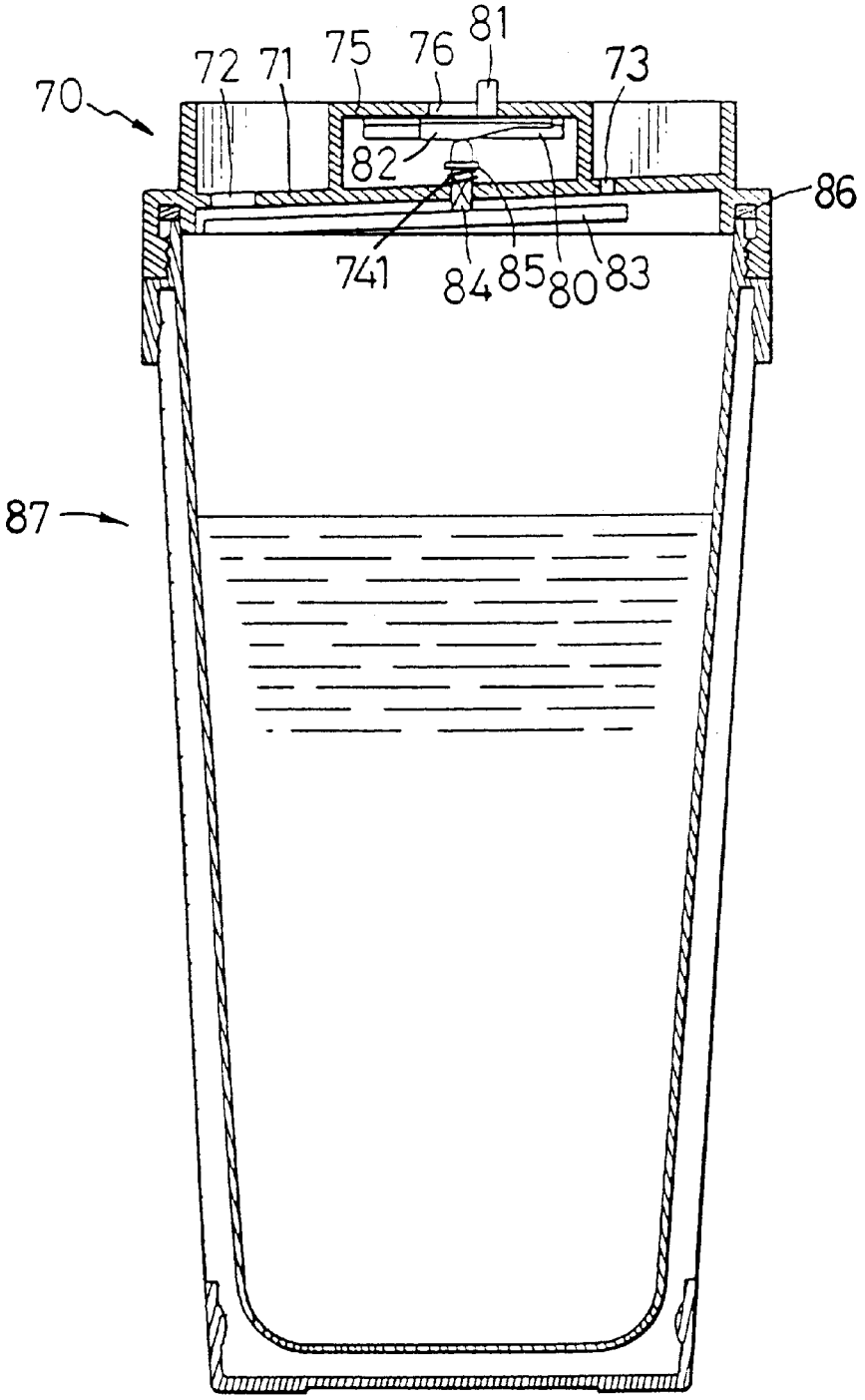
FIG.6 PRIOR ART
FIG. 6 is a front plan cross-sectional assembly view of the conventional container lid assembly as shown in FIG. 5.

Referring now to FIGS. 1–3, a lid assembly in accordance with the present invention can be fit onto a container body (68) of a container such as a thermos cup which is used in an automobile. The lid assembly comprises a lid body (20) including a periphery containing a liquid discharge slot (25) and an air vent (261) arranged radially opposite to each other, and a center containing a passage (241) located between the liquid discharge slot (25) and the air vent (261), a rotary cap (10) rotatably mounted on the top of the lid body (20) and including a drive post (13) extending downward from the bottom thereof and extending through the passage (241), a control device (40) mounted on the bottom of the lid body (20) and secured to the drive post (13) to rotate therewith. In such a manner, the control device (40) can be rotated by the drive post (13) to move between a first position as shown in FIG. 3 where the liquid discharge slot (25) and the air vent (261) are closed by the control device (40), and a second position as shown in FIG. 4 where the liquid discharge slot (25) and the air vent (261) are detached from and opened by the control device (40).

The lid body (20) includes an upper portion (21) having a stepped bottom including an upper bottom plate (23) having a lug (24) extending downward and containing the passage (241) for receiving the drive post (13), and a lower bottom plate (231) containing the liquid discharge slot (25). The rotary cap (10) is rotatably mounted on the upper bottom plate (23) of the lid body (20). The lid body (20) further includes an enlarged lower portion (22) containing an inner thread (221) defined on the inner wall thereof and engaged with an outer thread (680) formed on the outer wall of the container body (68), and an annular gasket (30) is mounted in the inner wall of the lid body (20). The upper bottom plate (23) of the lid body (20) includes a stub (26) extending downward therefrom containing the air vent (261).

The drive post (13) includes a square control block (14) extending downward from the bottom thereof and protruding outward from the lug (24), and the control device (40) includes a flexible upper strip (50) having a first end portion (55) located under the liquid discharge slot (25), a mediate portion (51) containing a square locking hole (52) receiving the control block (14) such that the upper strip (50) is rotated with the drive post (13), and a second end portion (56) located under the air vent (261), a positioning block (57) secured on the first end portion (55) of the upper strip (50), a sealing gasket (58) secured on the positioning block (57) and detachably abutting the liquid discharge slot (25), and a sealing plug (561) secured on the second end portion (56) of the upper strip (50) and detachably abutting the air vent (261).

The sealing gasket (58) contains an oblong slot (580) defined therein, and the positioning block (57) includes an oblong plug (571) extending upward and fitted into the oblong slot (580). The second end portion (56) of the upper strip (50) contains a locking notch (560) securely receiving the sealing plug (561) therein.

The lid assembly further comprises a cushion (31) mounted between the lug (24) and the mediate portion (51) of the upper strip (50) and containing a square hole (310) for receiving the control block (14).

The upper bottom plate (23) of the lid body (20) includes an annular flange (27) extending downward from the bottom thereof and containing a plurality of concave openings (271) defined in the bottom thereof, and the mediate portion (51) of the upper strip (50) has a press block (541) on both sides of the locking hole (52) extending upward to press the bottom of the annular flange (27) and detachably received in one of the concave openings (271). The mediate portion (51) of the upper strip (50) includes two reduced necks (53) each formed on one side of the locking hole (52).

The control device (40) further comprises a flexible lower strip (60) pressing the bottom of the upper strip (50) and including a mediate portion (61) containing a square locking hole (62) receiving the control block (14) such that the lower strip (60) is rotated with the drive post (13). The control device (40) further comprises a connector (65) abutting the bottom of the lower strip (60) and containing a recess (66) for receiving the control block (14) therein. The control block (14) contains a threaded bore (15) therein, the connector (65) further contains a hole (650) defined in the bottom thereof and connecting to the threaded bore (15), and the control device (40) further comprises a locking screw (67) extending through the bore (650) and screwed into the threaded bore (15) of the control block (14), thereby securely locking the upper strip (50) together with the lower strip (60) between the cushion (31) and the connector (65).

In operation, referring to FIG. 3 and 4 with reference to FIGS. 1 and 2, the upper strip (50) of the control device (40) is initially in the first position as shown in FIG. 3 where the liquid discharge slot (25) and the air vent (261) are closed by the sealing gasket (58) and the sealing plug (561) respectively such that the lid body (20) is sealed by the control device (40), thereby preventing liquid contained in the container body (68) from flowing outward from the liquid discharge slot (25).

The rotary cap (10) can then be rotated relative to the lid body (20) so as to rotate the drive post (13) together with the control block (14) which in turn rotates the upper strip (50) of the control device (40) to the second position as shown in FIG. 4 where the liquid discharge slot (25) and the air vent (261) are each detached from the sealing gasket (58) and the sealing plug (561) respectively, thereby opening the container body (68) such that liquid contained in the container body (68) can flow outward from the liquid discharge slot (25).

A first stop stub (28) is mounted on the bottom of the lower bottom plate (231) of the lid body (20) and located adjacent to the liquid discharge slot (25) for limiting further movement of the first end portion (55) of the upper strip (50) as shown in FIG. 3. A second stop stub (29) is mounted on the bottom of the upper bottom plate (23) of the lid body (20) and located adjacent to the air vent (261) for limiting further movement of the second end portion (56) of the upper strip (50) as shown in FIG. 3.

It should be clear to those skilled in the art that further embodiments may be made without departing from the scope and spirit of the present invention.

What is claimed is:

1. A lid assembly comprising:

a lid body (20) including a periphery containing a liquid discharge slot (25) and an air vent (261) arranged radially opposite to each other, and a center containing a passage (241) located between said liquid discharge slot (25) and said air vent (261);

a rotary cap (10) rotatably mounted on the top of said lid body (20) and including a drive post (13) extending downward from the bottom thereof, and extending through said passage (241);

a control device (40) mounted on the bottom of said lid body (20) and secured to said drive post (13) to rotate therewith, said control device (40) being rotated by said drive post (13) between a first position where said liquid discharge slot (25) and said air vent (261) are closed by said control device (40), and a second position where said liquid discharge slot (25) and said air vent (261) are detached from and opened by said control device (40).

2. The lid assembly in accordance with claim 1, wherein said lid body (20) includes an upper portion (21) having a stepped bottom having an upper bottom plate (23) including a lug (24) extending downward therefrom containing said passage (241) for receiving said drive post (13), and a lower bottom plate (231) containing said liquid discharge slot (25).

3. The lid assembly in accordance with claim 2, wherein said lid body (20) includes an enlarged lower portion (22) containing an inner thread (221) defined in the inner wall thereof.

4. The lid assembly in accordance with claim 3, further comprising an annular gasket (30) mounted in the inner wall of said lid body (20).

5. The lid assembly in accordance with claim 2, wherein said upper bottom plate (23) of said lid body (20) includes a stub (26) extending downward therefrom containing said air vent (261).

6. The lid assembly in accordance with claim 2, wherein said drive post (13) includes a square control block (14) extending downward from the bottom thereof and protruding outward from said lug (24), and said control device (40) includes a flexible upper strip (50) having a first end portion (55) located under said liquid discharge slot (25), a mediate portion (51) containing a square locking hole (52) receiving said control block (14) such that said upper strip (50) is rotated with said drive post (13), and a second end portion (56) located under said air vent (261), a positioning block (57) secured on said first end portion (55) of said upper strip (50), a sealing gasket (58) secured on said positioning block (57) and detachably abutting said liquid discharge slot (25), and a sealing plug (561) secured on said second end portion (56) of said upper strip (50) and detachably abutting said air vent (261).

7. The lid assembly in accordance with claim 6, further comprising a cushion (31) mounted between said lug (24) and said mediate portion (51) of said upper strip (50) and containing a square hole (310) for receiving said control block (14).

8. The lid assembly in accordance with claim 6, wherein said upper bottom plate (23) of said lid body (20) includes an annular flange (27) extending downward from the bottom thereof and containing a plurality of concave openings (271) defined in the bottom thereof, and said upper strip (50) has a press block (541) on each side of the locking hole (52) extending upward to press the bottom of said annular flange (27) and be detachably received in one of said concave openings (271).

9. The lid assembly in accordance with claim 8, wherein said upper strip (50) includes two reduced necks (53) each formed on one side of said locking hole (52).

10. The lid assembly in accordance with claim 6, wherein said sealing gasket (58) contains an oblong slot (580) defined therein, and said positioning block (57) includes an oblong plug (571) extending upward and fit into said oblong slot (580).

11. The lid assembly in accordance with claim 6, wherein said second end portion (56) of said upper strip (50) contains a locking notch (560) securely receiving said sealing plug (561) therein.

12. The lid assembly in accordance with claim 6, wherein said control device (40) further comprises a flexible lower strip (60) pressing the bottom of said upper strip (50) and including a mediate portion (61) containing a square locking hole (62) receiving said control block (14) such that said lower strip (60) is rotated with said drive post (13).

13. The lid assembly in accordance with claim 12, wherein said control device (40) further comprises a connector (65) abutting the bottom of said lower strip (60) and containing a recess (66) for receiving said control block (14) therein.

14. The lid assembly in accordance with claim 13, wherein said control block (14) contains a threaded bore (15) therein, a connector (65) contains a hole (650) defined in the bottom thereof and connecting to said threaded bore (15), and said control device (40) further comprises a locking screw (67) extending through said bore (650) and screwed into said threaded bore (15) of said control block (14).

15. The lid assembly in accordance with claim 6, wherein said lid body (20) includes a first stop stub (28) mounted on the bottom of said lower bottom plate (231) located adjacent to said liquid discharge slot (25) for limiting further movement of said first end portion (55) of said upper strip (50).

16. The lid assembly in accordance with claim 6, wherein said lid body (20) includes a second stop stub (29) mounted on the bottom of said upper bottom plate (23) located adjacent to said air vent (261) for limiting further movement of said second end portion (56) of said upper strip (50).

* * * * *